US009403050B2

(12) United States Patent
Kovach

(10) Patent No.: US 9,403,050 B2
(45) Date of Patent: Aug. 2, 2016

(54) EXERCISE APPARATUS

(71) Applicant: Marcus Kovach, Huntingdon Beach, CA (US)

(72) Inventor: Marcus Kovach, Huntingdon Beach, CA (US)

( * ) Notice: Subject to any disclaimer, the term of this patent is extended or adjusted under 35 U.S.C. 154(b) by 0 days.

(21) Appl. No.: 14/586,410

(22) Filed: Dec. 30, 2014

(65) Prior Publication Data

US 2015/0174443 A1 Jun. 25, 2015

Related U.S. Application Data

(63) Continuation of application No. 13/476,626, filed on May 21, 2012, now Pat. No. 8,951,173.

(51) Int. Cl.

| | |
|---|---|
| ***A63B 21/072*** | (2006.01) |
| ***A63B 21/00*** | (2006.01) |
| ***A63B 21/06*** | (2006.01) |
| *A63B 71/06* | (2006.01) |

(52) U.S. Cl.

CPC ..... *A63B 21/0726* (2013.01); *A63B 21/0004* (2013.01); *A63B 21/00069* (2013.01); *A63B 21/0602* (2013.01); *A63B 21/0603* (2013.01); *A63B 21/072* (2013.01); *A63B 21/4035* (2015.10); *A63B 2071/0694* (2013.01)

(58) Field of Classification Search

CPC ..... A63B 21/00
USPC ..... 482/104, 109, 110, 92, 106
See application file for complete search history.

(56) References Cited

U.S. PATENT DOCUMENTS

| | | | | |
|---|---|---|---|---|
| 3,820,781 | A | 6/1974 | Kane | |
| 4,043,553 | A * | 8/1977 | Suarez | A63B 21/0608 482/106 |
| 4,505,474 | A | 3/1985 | Mattox | |
| 5,312,314 | A | 5/1994 | Stephan et al. | |
| 5,580,321 | A * | 12/1996 | Rennhack | A63B 15/00 473/234 |
| 7,244,220 | B2 | 7/2007 | Carney | |
| 2003/0077920 | A1 * | 4/2003 | Noda | C23C 16/24 438/788 |
| 2011/0251030 | A1 | 10/2011 | Pfitzer | |
| 2014/0256515 | A1 * | 9/2014 | Jones | A63B 21/0602 482/93 |

* cited by examiner

*Primary Examiner* — Jerome w Donnelly
(74) *Attorney, Agent, or Firm* — One LLP

(57) ABSTRACT

An apparatus for exercising muscles of a user. At least one member has a dynamic mass distribution that changes according to an orientation of the apparatus. The orientation of the apparatus may be altered by the user so as to exercise the user's muscles.

6 Claims, 3 Drawing Sheets

EXERCISE APPARATUS

CROSS-REFERENCE TO RELATED APPLICATIONS

This application is a continuation of application Ser. No. 13/476,626 filed May 21, 2012, which is incorporated by reference herein.

BACKGROUND OF THE INVENTION

Physical fitness is an increasingly important past time. Of late, it has become more important as rates of obesity, heart disease, adult onset diabetes and other health related issues have increased to keep pace with the ready availability of fast food and an increasingly sedentary lifestyle.

As such, exercise technology is highly developed and workout routines are becoming increasingly tailored to target goals. One of the more popular methods—isometric exercises—is an increasingly popular training method in gymnasiums across the country. These exercises concentrate on specific muscles or muscle groups. This is particularly important for competitive body-building, and much of the equipment found in a gymnasium is targeted towards these types of exercises. As such, gym-goers tend to over utilize this type of equipment. This overuse may lead to the overtraining of certain muscles while under training other associated muscles, increasing the risk of debilitating injury.

While these exercises tend to focus on movement specific strength, competitive sports such as mixed-martial-arts, for example, tend to value what may be termed functional strength. Functional strength involves the utilization of muscles that are not exercised in static conditions. Instead, increasing functional strength generally requires a destabilization of the exercise movement and generally involves muscles, such as those associated with the core and hips, not usually associated with static exercise movements.

Various exercise apparatuses have been previously known to provide functional strength exercise. The shake weight, for example, utilizes a motorized dumbbell that oscillates with respect to a handle. However, it is expensive, difficult to maintain and does not provide sufficient variability of resistance.

It is therefore desirable to provide an exercise apparatus which may overcome these disadvantages.

SUMMARY OF THE INVENTION

An exercise apparatus is described herein that overcomes the limitations noted above. An apparatus for exercising muscles of a user is provided. The apparatus may comprise least one member having a dynamic mass distribution. The dynamic mass distribution may be according to an orientation of the apparatus. The orientation of the apparatus may be altered by the user so as to exercise the user's muscles. The dynamic mass distribution may be adjustable.

The primary objective of this invention is to provide an exercise apparatus having a dynamic mass distribution.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWINGS

Illustrated in the accompanying drawing(s) is at least one of the best mode embodiments of the present invention. In such drawing(s).

DETAILED DESCRIPTION OF THE PREFERRED EMBODIMENTS

The above described drawing figures illustrate the described invention and method of use in at least one of its preferred, best mode embodiment, which is further defined in detail in the following description. Those having ordinary skill in the art may be able to make alterations and modifications to what is described herein without departing from its spirit and scope. Therefore, it should be understood that what is illustrated is set forth only for the purposes of example and should not be taken as a limitation on the scope of the present apparatus and its method of use.

Figure 1:
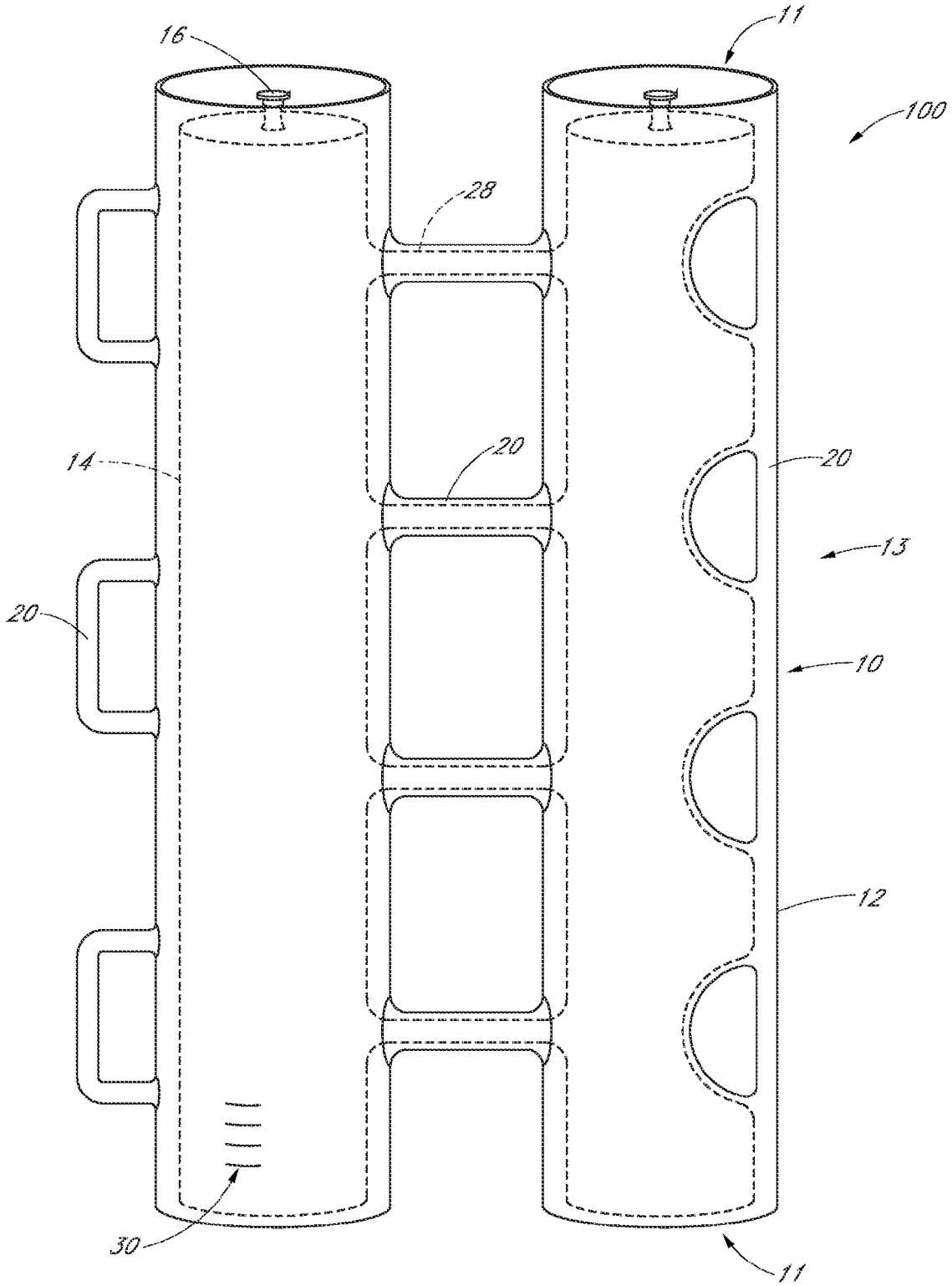
FIG. 1 illustrates an exercise apparatus according to at least one embodiment of the present invention.

As illustrated in FIG. 1, an exercise apparatus 100 comprises: at least one elongated member 10 coupled to at least one handle 20 operable to enable a user to grip the apparatus so as to move or resist movement thereof and thereby exercise the user's muscles.

The elongated member may comprise a body 12 that has an associated inertia according to its mass distribution. The inertia of the body 12 operates to resist a change in location of the body 12, and ultimately of the apparatus 100. The user may move the apparatus and utilize the body's 12 inertia to exercise the muscles involved.

In some embodiments, the body 12 of the elongated member 10 may comprise one or more cavities 14 operable to affect the mass distribution of the body 12. To further effectuate change to the mass distribution, the cavities may be partially or wholly filled with fluid, or a fluid-like substance, although it is contemplated that the cavities may contain non-fluids, or a combination of fluids and non-fluids.

In some embodiments, the cavities 14 are partially filled with a fluid, so as to cause the mass distribution of the elongated member 10 to be dynamic—that is, to be variable according to instantaneous orientation, or change in orientation, of the body 12. For example, the cavity 14 may be partially filled with water that may move from one location in the cavity 14 to another location in the cavity, thereby causing the mass distribution of the body 12 to change. When the mass distribution of the body 12, and thus the apparatus 100, is altered during the user's exercise movements involving the apparatus 100, the user may be required to utilize muscles other than the target muscles of the exercise in order to stabilize the apparatus 100 during the movement. User stabilization of the apparatus 100 during exercise movement may cause an increase in the exercise of the user's muscles over movements in which there is no user stabilization.

While the foregoing example illustrates the cavities 14 containing water, the cavities 14 may contain one or more of: other fluids, non-fluids, or fluid-like substances. For example, the cavities 14 may contain: sand, gravel, weighted spheres, or other granular substances; jelly, oil, putty, or other viscious, semi-viscious, or inviscid substances. Furthermore, in some embodiments the body 12 may comprise one or more cavities 14.

In some embodiments, the elongated member 10 may comprise at least one sealable access point 16 coupled to the cavity 14 for permitting access thereto. The access point 16 may comprise an aperture 18 and cap 19 removably secured thereon. The cap 19 may be removed so as to permit the cavity 14 to be partially or wholly filled with, for example, a fluid, or a fluid-like substance. The cap 19 may then be secured to the aperture 18 so as to prevent the escape of the fluid, or fluid-like substance. Additionally, the cap 19 may be removed from the aperture 18 so as to permit the removal of the fluid, or fluid-like substance. In this manner, the dynamic mass distribution of the body 14 may further be affected.

Turning now to FIG. 1, one or more handles 20 may be coupled to the elongated member 10 so as to affect the resistance experienced by the user's muscles when imparting or resisting motion of the apparatus 100. For example, when the handle 20 that the user grips is located nearer to an end 11 of the elongated member 10, the user may experience increased rotational force acting on the user's muscles, compared to the rotational force the user may experience when the gripped handle 20 is located more central 13 to the elongated member 10.

Figure 2B:
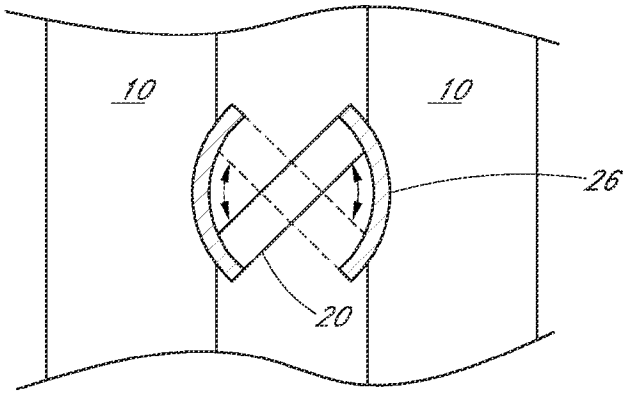
FIG. 2A-2D illustrates various handles according to at least one embodiment of the present invention.
Figure 2D:
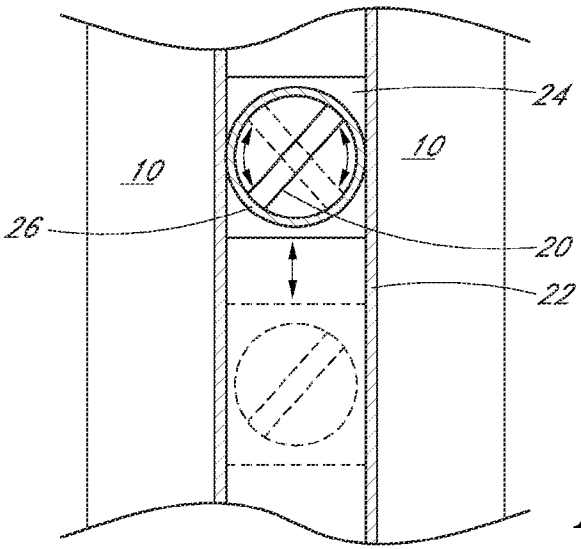
Figure 2A:
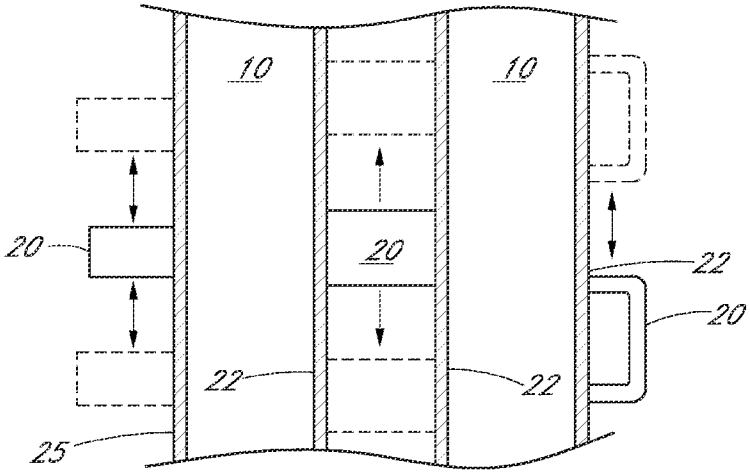
Figure 2C:
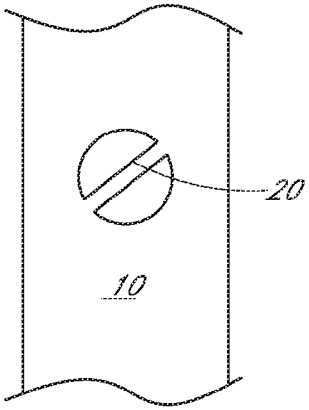

In some embodiments, the handles 20 may be at least one of: perpendicularly coupled to the elongated members 10, as shown for example in FIG. 2A, for example; coupled so as to be parallel to the elongated members 10, as shown for example in FIG. 2A, for example; and coupled through negative space with respect to the elongated members 10, as shown for example in FIG. 2C.

In some embodiments, one or more handles 20 comprise intermediary cavities 28 for connecting cavities 14 of elongated members 10 coupled by the handles 20. In this manner, the fluid-like substance may traverse adjacent cavities 14 and affect the resistance experienced by the user's muscles when imparting or resisting motion of the apparatus 100.

In some embodiments of the present invention, the user may adjust the position of one or more handles 20 with respect to one or more elongated members 10 so as to affect the resistance experienced by the user's muscles when imparting or resisting motion of the apparatus 100. Adjustment may be made by techniques now known or hereinafter developed without departing from the scope of the invention.

As shown in FIG. 2A, in at least one preferred embodiment, one or more handles 20 may be longitudinally adjustable relative to the elongated member 10. The elongated member 10 may comprise a longitudinal track 22 for accepting the handle 20 such that the handle 20 may be adjusted along the length of the longitudinal track 22. A locking mechanism (not shown) may operate to fix the handle 20 relative to the longitudinal track 22. A release mechanism (not shown) may operate to unfix the handle 20 therefrom.

As shown in FIG. 2B, in at least one preferred embodiment, one or more handles 20 may be rotationally adjustable relative to the elongated member 10. The elongated member 10 may comprise an arcuate track 26 for accepting the handle 20 such that the handle 20 may be adjusted along the length of the arcuate track 26 so as to be rotationally adjustable relative to the elongated member 10. A locking mechanism (not shown) may operate to fix the handle 20 relative to the arcuate track 26. A release mechanism (not shown) may operate to unfix the handle 20 therefrom.

As shown in FIG. 2D, in at least one preferred embodiment, one or more handles 20 may be both longitudinally adjustable relative to the elongated member 10 rotationally adjustable relative to the elongated member 10. The elongated member 10 may comprise longitudinal track 22 coupled to an adapter 24 such that the handle 20 may be adjusted along the length of the longitudinal track 22 so as to be longitudinally adjustable relative to the elongated member 10. The adapter 24 may comprise rotational track 26 coupled to the handle 20 such that the handle 20 may be adjusted along the length of the arcuate track 26 so as to be rotationally adjustable relative to the elongated member 10. In this manner, the handles 20 may be both rotationally and longitudinally adjustable relative to the elongated member 10. One or more locking mechanisms (not shown) may operate to fix the handle 20 relative to the rotational track 22 of the adaptor 24 and/or the adapter 24 to the longitudinal track 22. One or more release mechanisms (not shown) may operate to unfix the handle 20 from the rotational track 22 of the adaptor 24 and/or the adapter 24 from the longitudinal track 22.

In some embodiments, the track 22, 26 may comprise a cross-section that is substantially C-shaped, and the handle 20 may comprise an appendage (not shown) substantially engageable therewith so as to cause the handle 20 to be adjustably coupled to the track 22, 26. A locking mechanism (not shown) may operate to fix the handle 20 relative to the track 22, 26. Alternatively, the handle 20 may comprise a member having a substantially C-shaped cross-section (not shown), and the track 22, 26 may comprise an appendage (not shown) substantially engageable therewith so as to cause the handle 20 to be adjustably coupled to the track 22, 26.

In some embodiments, the handle 20 may be secured to the elongated member 10 via a noose-like structure (not shown) that engages the elongated member 10 and secures the handle 20 thereto via a frictional force. The handle 20 may permit tightening and un-tightening of the noose-like structure so as to enable the handle 20 to be de-coupled from the elongated member 10 and to be adjusted relative thereto.

It will be understood that one or more handles 20 may be adjustable according to one or more of the techniques described above, or any combination thereof, without departing from the scope of the invention.

In some embodiments, one or more handles 20 may be removably coupled to the elongated member 10. In this manner, one or more handles 20 may be removed from the apparatus 100 so as to affect the resistance experienced by the user's muscles when imparting or resisting motion of the apparatus 100. Additionally, one or more elongated members 10 may be detached from the handles 20 so as to be exchangeable with substitute elongated members 10. The substitute elongated members 10 may have a mass distribution and/or a range of possible dynamic mass distributions that are different from that of the elongated members 10. This may be because one or more of: the cavity 14 size of the substitute elongated member 10 is different from that of the elongated member 10; the material for constructing the body 12 of the substitute elongated member 10 is different from that of the elongated member 10; the body 12 size of the substitute elongated member 10 is different from that of the elongated member 10; and the substance filling or partially-filling of the substitute elongated member 10 is different from that of the elongated member 10.

Figure 4A:
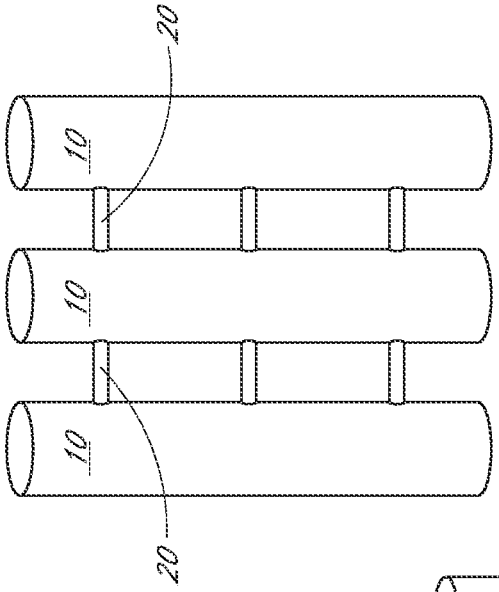
FIG. 4A-4B illustrates various exercise apparatuses according to at least one embodiment of the present invention.
Figure 4B:
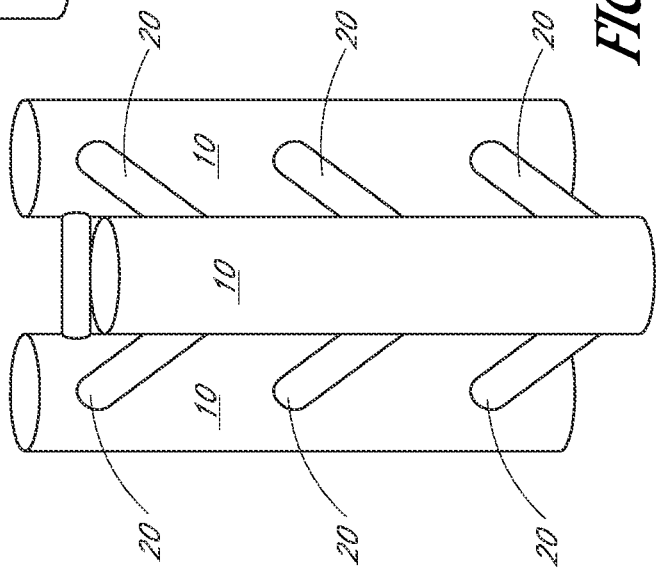
Figure 3:
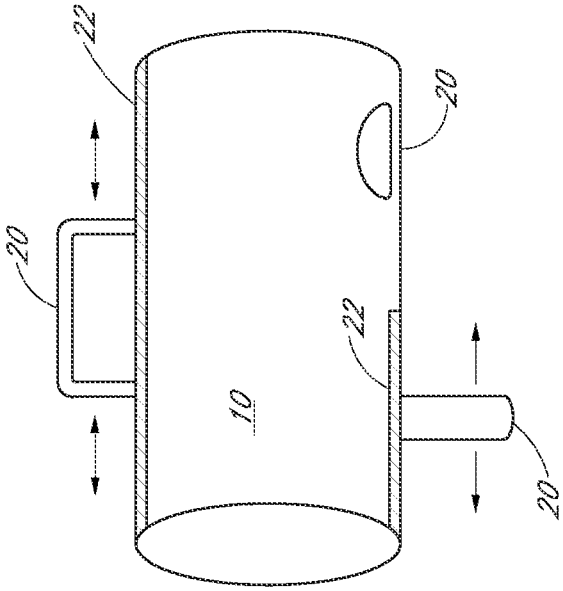
FIG. 3 illustrates an exercise apparatus according to at least one embodiment of the present invention.

Turning now to FIG. 4, in some embodiments, a plurality of elongated members 10 may be in parallel configuration relative to each other. For example, as shown in FIG. 4A, two or more elongated members 10 may be parallel to each other and one or more handles 20 may be perpendicularly coupled to each of the elongated members 10 such that the apparatus has a substantially linear cross section. In an alternative example shown in FIG. 4B, three or more elongated members 10 may be in mutually parallel configuration relative to each other—in other words, each elongated member 10 may be in parallel configuration with each other elongated member 10. One or more handles 20 may be perpendicularly coupled to each of the elongated members 10 such that the apparatus 100 has a substantially polygonal cross section. In this manner, the user may affect the resistance experienced by the user's muscles when imparting or resisting motion of the apparatus 100.

In some embodiments, the elongated member 10 may be constructed of substantially rigid materials, such as, for example: metals, plastics, glasses, or polymers. In some embodiments, the handles 20 may be constructed of substantially rigid materials, such as, for example: metals, plastics, glasses, or polymers.

In some embodiments, the body 12 of one or more elongated members 10 is constructed of a substantially transparent material, such as for example, plastic. The body 12 may comprise indicia 30 that indicates to the user one or more of the following: a volume of fluid-like substance present in the cavity 14; a mass distribution of the apparatus at rest according to the fluid-like substance present; a dynamic mass distribution range of the apparatus according to a selected path of movement and fluid-like substance present; a resistance applied to the user's muscles based thereon. For example, a user may fill cavity 14 with water to indicia 30 indicating that a curl motion executed with handles 20 at given positions will provide a certain resistance or resistance range.

It will be appreciated that while the present embodiment is preferably practiced with shorts, the present invention is applicable to pants, for example sweat pants or warm-ups. In such embodiments, the second material may be placed approximately at the opposing lateral sides of such pants so that the user may wipe perspiration from his hands. Furthermore, while the embodiments described above identify specific locations for the second material, one or more of said locations may be utilized in combination with each other, or with any other locations on the athletic apparel body portion.

The enablements described in detail above are considered novel over the prior art of record and are considered critical to the operation of at least one aspect of the invention and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that the named inventor believes that the claimed subject matter is what is intended to be patented.

What is claimed is:

1. An apparatus for exercising muscles of a user, comprising:

at least one elongated member having a dynamic mass distribution according to an orientation of the apparatus; and at least one handle coupled to the elongated member for the user to grasp;

wherein the orientation of the apparatus may be altered by the user so as to exercise the muscles of the user;

wherein at least one elongated member is exchangeable for at least one other elongated member; and wherein the at least one elongated member has a dynamic mass distribution that is different from the dynamic mass distribution of the at least one other elongated member.

2. An apparatus for exercising muscles of a user, comprising:

at least one elongated member having a dynamic mass distribution according to an orientation of the apparatus; and at least one handle coupled to the elongated member for the user to grasp;

wherein the orientation of the apparatus may be altered by the user so as to exercise the muscles of the user;

wherein two or more elongated members each comprise a body having at least one cavity at least partially filled with a fluid-like substance; and wherein at least one handle comprises an intermediary cavity coupling the cavities of the two or more elongated members.

3. An apparatus for exercising muscles of a user, comprising:

at least one elongated member having a dynamic mass distribution according to an orientation of the apparatus; and at least one handle coupled to the elongated member for the user to grasp;

wherein the orientation of the apparatus may be altered by the user so as to exercise the muscles of the user; and wherein two or more elongated members are disposed parallel to each other;

wherein a set consists of exactly two elongated members disposed parallel to each other; and wherein one or more handles perpendicularly connect each set of elongated members.

4. An apparatus for exercising muscles of a user, comprising:

at least one elongated member having a dynamic mass distribution according to an orientation of the apparatus;

at least one handle coupled to the elongated member for the user to grasp;

a longitudinal track coupling the elongated member to the handle so as to permit the handle to be longitudinally adjusted relative to the elongated member; and wherein the orientation of the apparatus may be altered by the user so as to exercise the muscles of the user.

5. An apparatus for exercising muscles of a user, comprising:

at least one elongated member having a dynamic mass distribution according to an orientation of the apparatus;

at least one handle coupled to the elongated member for the user to grasp;

a rotational track coupling the elongated ember to the handle so as to permit the handle to be rotationally adjusted relative to the elongated member; and wherein the orientation of the apparatus may be altered by the user so as to exercise the muscles of the user.

6. An apparatus for exercising muscles of a user, comprising:

at least one elongated member having a dynamic mass distribution according to an orientation of the apparatus;

at least one handle coupled to the elongated member for the user to grasp;

an adapter for coupling the handle to the elongated member, the adapter being coupled to the handle so as to permit selective rotation of the handle relative to the adapter, the adapter being coupled to the elongated member so as to permit selective longitudinal adjustment of the adapter relative to the elongated member; and wherein the orientation of the apparatus may be altered by the user so as to exercise the muscles of the user.

* * * * *